US006955596B1

(12) United States Patent
Walker et al.

(10) Patent No.: US 6,955,596 B1
(45) Date of Patent: Oct. 18, 2005

(54) AIR FLOW PRODUCER FOR REDUCING ROOM TEMPERATURE GRADIENTS

(76) Inventors: Keith Lloyd Walker, 2210 Dale Ridge Drive, Oakville, Ontario (CA) L6M 3L4; Michael Arthur Coulter, 2158 Fowler Lane, Mississauga, Ontario (CA) L5K 1B8

( * ) Notice: Subject to any disclaimer, the term of this patent is extended or adjusted under 35 U.S.C. 154(b) by 0 days.

(21) Appl. No.: 10/925,918

(22) Filed: Aug. 26, 2004

(51) Int. Cl.[7] ..... F24F 7/007
(52) U.S. Cl. ..... 454/230; 454/231
(58) Field of Search ..... 454/230, 231, 454/233, 338

(56) References Cited

U.S. PATENT DOCUMENTS 2,301,045 A * 11/1942 Heath ..... 454/233
2,700,331 A * 1/1955 Miller ..... 454/230
3,827,342 A * 8/1974 Hughes ..... 454/231
4,628,798 A * 12/1986 Tagnon ..... 454/233
5,350,337 A * 9/1994 Kondo et al. ..... 454/189
5,624,311 A * 4/1997 Peludat ..... 454/230

FOREIGN PATENT DOCUMENTS

NL 8203932 * 5/1984 ..... 454/230

* cited by examiner

*Primary Examiner*—Harold Joyce

(57) ABSTRACT

An air flow producer mounted at the ceiling of a room generates an air flow toward the floor, reducing temperature gradients and improving heating and cooling efficiency. A housing defines a circular cylindrical, vertical flow passage that receives the air flow. A discharge chamber discharges the air flow through a grill toward the floor. The discharge chamber has a cross-section that expands progressively from the outlet of the flow passage to the outlet of the discharge chamber. The air flow through the housing is produced by a fan with a rotary blade assembly, and the blade assembly extends partially into the discharge chamber. The position of the blade assembly and the expanding cross-section of the discharge chamber cooperate to increase air flows through the housing. Optionally, an air intake chamber of generally inverted frustoconical shape may be mounted at the upper inlet end of the cylindrical flow passage to smooth flows further.

10 Claims, 4 Drawing Sheets

AIR FLOW PRODUCER FOR REDUCING ROOM TEMPERATURE GRADIENTS

FIELD OF THE INVENTION

The invention relates generally to air flow producers for reducing temperature gradients within a room.

BACKGROUND OF THE INVENTION

It is well known that warm air forced into a room or derived from radiators tends to rise toward the ceiling of a room while cooler air tends to accumulate near the floor. This produces a temperature gradient that exposes individuals to colder room air and increases heat loss through ceilings and roofs. A corresponding problem arises during summer months. Individuals may experience a room as being hot because cool air discharged from air conditioning units tends to settle to the floor. Thermostat settings are often changed to obtain more heat or more cool air. In either case, the net result is increased energy consumption and higher cooling and heating costs.

It is also well known that ceiling fans can reduce room temperature gradients and consequently heating costs. The object is of course to mix hot air near a ceiling with cooler air near the floor to provide a comfortable temperature for individuals. Ceiling fans, however, are inefficient for such purposes. The air flow generated by a ceiling fan tends to spread horizontally far too quickly before reaching the floor. To reduce temperature gradients effectively, an air flow producer should ideally produce a vertical columnar air flow that actually reaches the floor. The air flow can then spread along the floor to entrain colder air along a floor, upward along walls, and then along a ceiling to the air flow producer for recirculation.

SUMMARY OF THE INVENTION

In one aspect, the invention provides an air flow producer adapted to reduce temperature gradients in a room. The air flow producer comprises a housing with a flow axis. In use, the housing may be supported proximate to a ceiling with its flow axis vertical. The housing defines a circular-cylindrical flow passage centered about the flow axis. One end of the flow passage defines an inlet for receiving an air flow, and an opposing end defines an outlet for discharging the air flow. A fan with a rotary blade assembly is mounted in the flow passage to produce the air flow. The blade assembly has a rotational axis aligned with the flow axis of the housing, and is positioned at the outlet of the flow passage.

Rather than discharge the air flow directly from the flow passage to the interior of the room, the housing has a discharge chamber that communicates directly with the flow passage to receive the air flow. The discharge chamber has an outlet spaced from the outlet of the flow passage and discharging the air flow into the interior of the room environment. The cross-sectional area of the discharge chamber, perpendicular to the flow axis, expands progressively from the outlet of the flow passage to the outlet of the discharge chamber. The blade assembly occupies a rotational space largely within the flow passage but extending partially into the discharge chamber. This arrangement appears to reduce turbulence created by fan blade rotation and has proven in actual testing to increase flow rates significantly. The discharge chamber is preferably formed with a frustoconical shape. A flow grill may be mounted over the outlet of the discharge chamber to focus flows, as in the prior art. In practice, the discharge chamber may necessitate only a minimal increase in the axial length of the housing but, with the blade assembly protruding partially into the chamber, the impact on flow rates is very significant.

Other aspects of the invention will be apparent from a description below of a preferred embodiment and will be more specifically defined in the appended claims. Also, the following terms should be understood to have the following means in this specification. The term "circular-cylindrical" and comparable terms should be under as comprising a cylindrical periphery with a circular cross-section. The term "frustoconical" is used in its normal means but for certainty should be understood as implying a central axis and a circular cross-section perpendicular to the axis that expands from one end to an opposite end. The term "rotational space" and comparable terms associated with a rotary blade assembly should be understood as the volume of revolution of the blade assembly about its rotational axis and, more specifically, the space defined or occupied by the volume of revolution.

DESCRIPTION OF THE DRAWINGS

The invention will be better understood with reference to drawings in which.

DESCRIPTION OF PREFERRED EMBODIMENT

Figure 1:
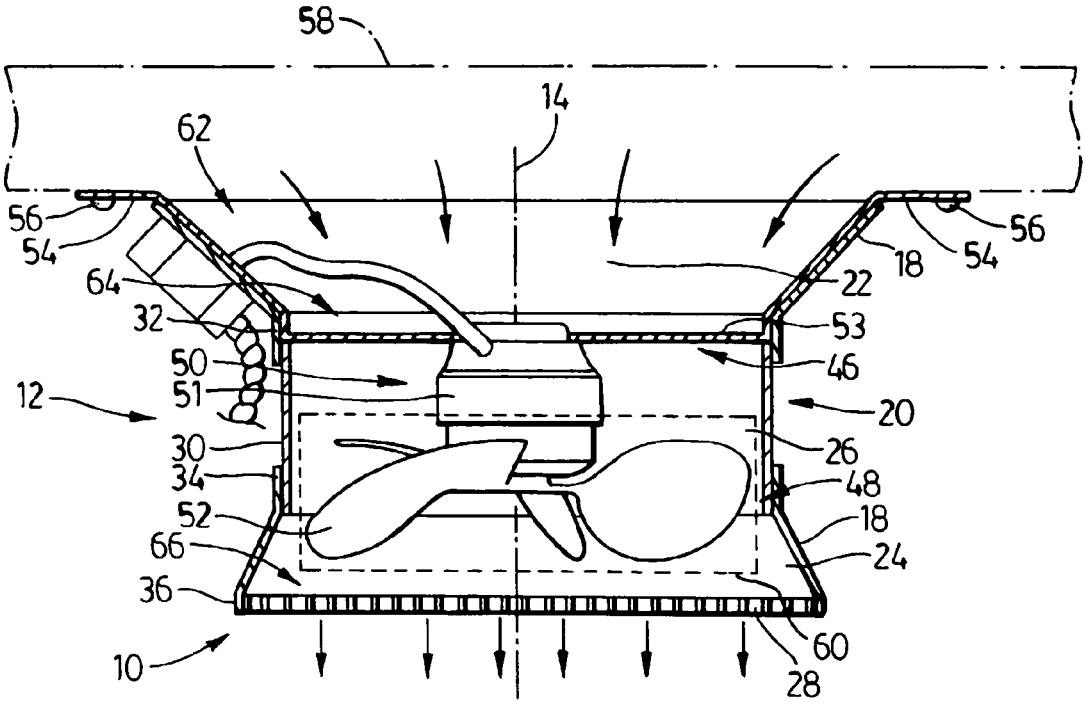
FIG. 1 is a vertical cross-section of an air flow producer mounted to structure (shown in phantom outline) proximate to the ceiling of a room.
Figure 2:
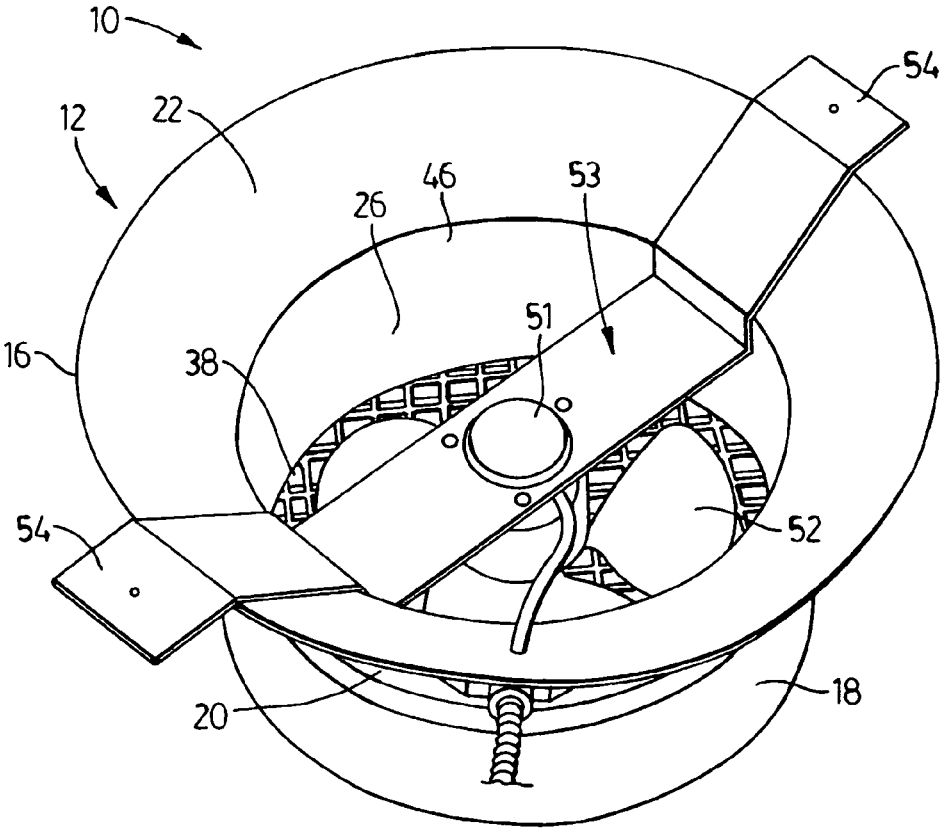
FIG. 2 a perspective view from above of the air flow producer.
Figure 3:
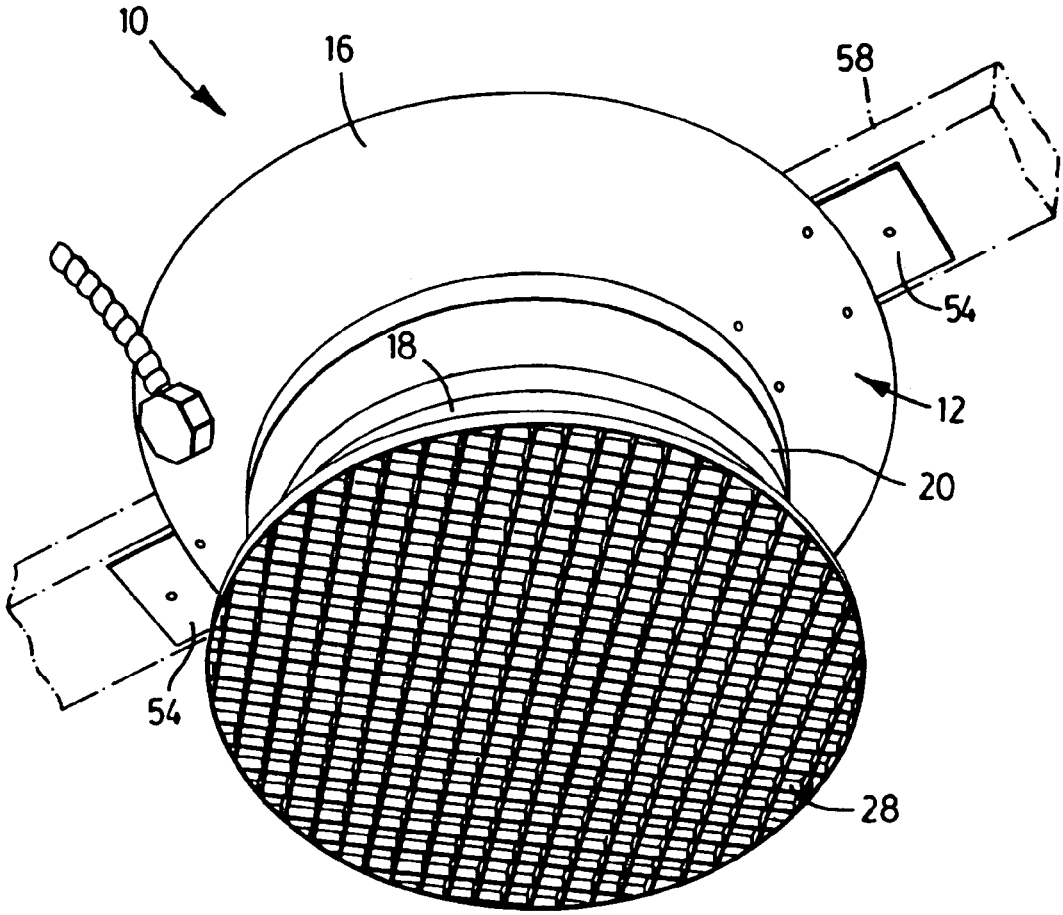
FIG. 3 a perspective view from below of the air flow producer.
Figure 4:
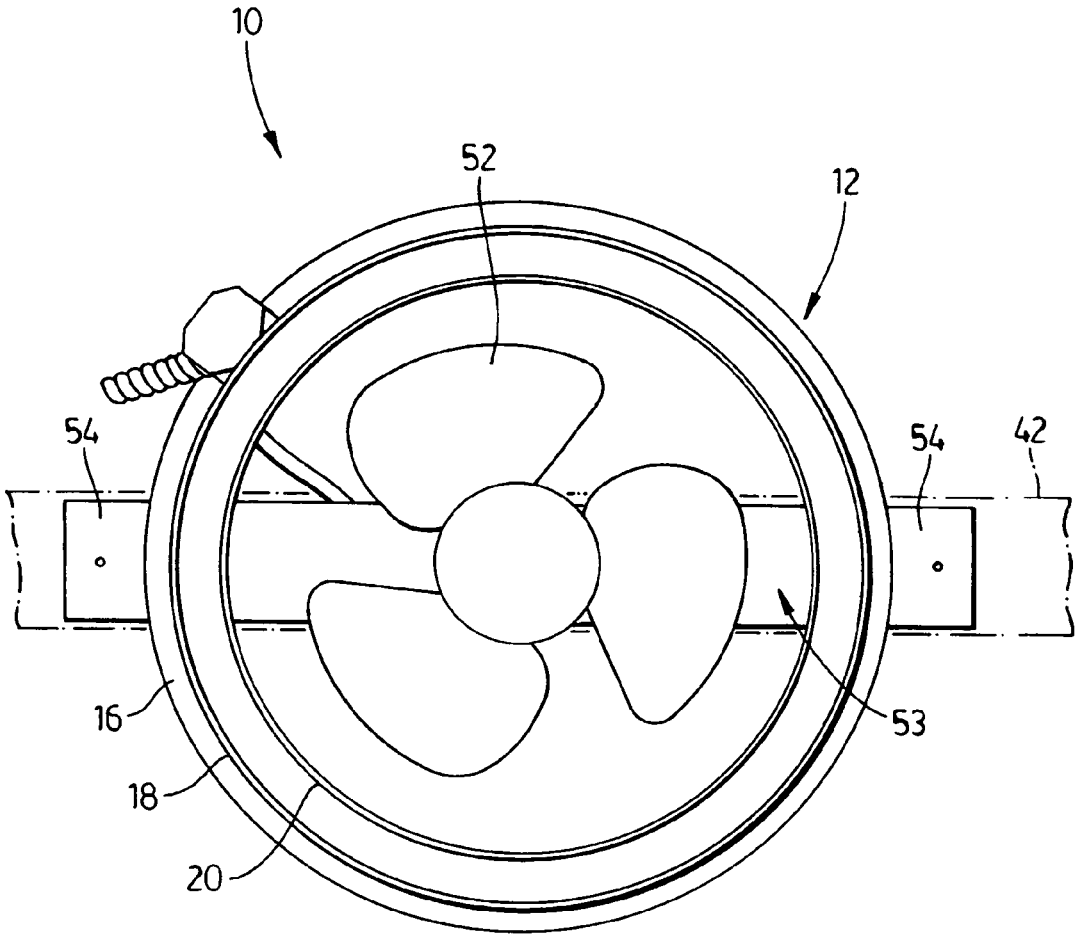
FIG. 4 is a plan view from below further detailing the mounting of the air flow producer to the ceiling structure; and, FIG. 5 is a perspective view of the air flow produce exploded along the flow axis of its housing.
Figure 5:
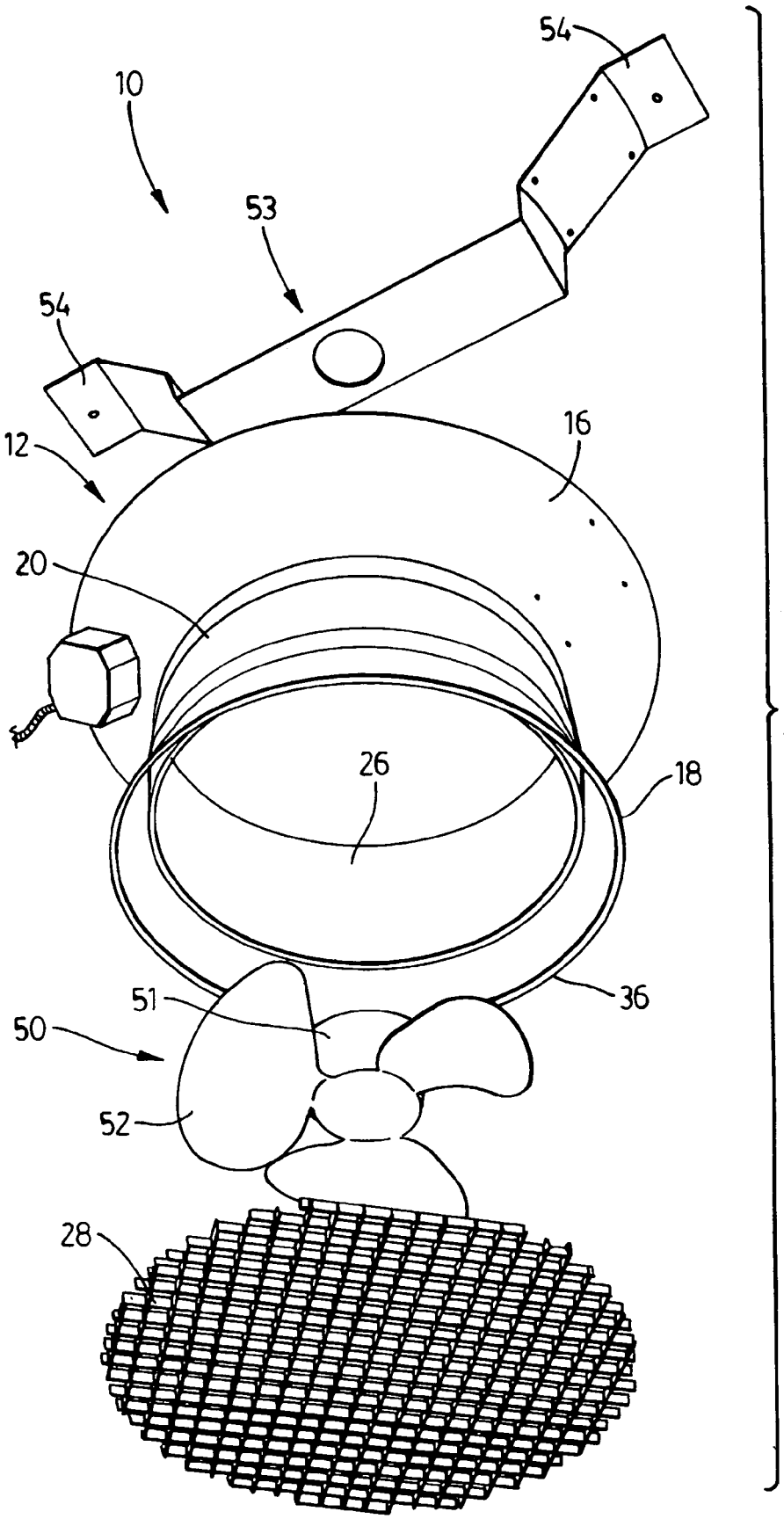

Reference is made to FIGS. 1–5 which illustrate an air flow producer 10 adapted to generated a high-volume air flow for destratifying layers of air and reducing temperature gradients. The air flow producer 10 includes a housing 12 with a flow axis 14 normally oriented vertical in an operative orientation, as in the cross-section of FIG. 2. To provide a light-weight construction, the housing 12 is formed of sheet metal in three main sections 16, 18, 20 aligned along the flow axis 14 of the housing 12. One end section 16 of the housing 12 (upper in the operative orientation of FIG. 1) defines a frustoconical intake chamber 22 centered about the flow axis 14. An opposing end section 18 of the housing 12 (lower in the operative orientation of FIG. 1) defines a frustoconical discharge chamber 24 centered about the flow axis 14. A central section 18 of the housing 12 defines a central, circular-cylindrical, flow passage 26 centered about the flow axis 14. The destratifying air flow is initially received in the intake chamber 22, flows through the central flow passage 26, and then flows into the discharge chamber 24. The air flow is then discharged from the discharge chamber 24 through a circular flow grill 28 into the room environment.

As regards matters of construction, and referring primarily to FIG. 1, it will be noted that the central housing section 20 has an outer surface 30 that is circular cylindrical. The upper housing section 16 and the lower housing section 18 are formed with circular collars 32, 34 conforming in shape to the outer surface 30 and closely receiving opposing ends of the central housing section 20. These collars 32, 34 are welded, soldered, or otherwise fastened and sealed to the central housing section 20. The lower housing section 18 is terminated with a circular collar 36 crimped along its periphery to retain the flow grill 28.

The flow grill 28 prevents accidental contact with the blade assembly 52 when rotating. It is specifically constructed to focus air flows parallel to its central flow axis (not indicated), which is aligned with the flow axis 14 of the housing 12. Such grills are well known and often formed with a latticework of plastic partitions or louvers or formed with other apertured structures, designed to reduce scattering of air flows and discharge air flows in a particular direction. Grills, screens or apertured members with such properties are referred to in this specification collectively as "flow grills" or "air flow grills."

The flow passage 26 has one end that defines a circular inlet 46 (upper in the operative orientation of FIG. 2) for receiving the air flow. The housing 12 has an opposing end that defines a circular outlet 48 (lower in the operative orientation of FIG. 2) for discharging the air flow. The inlet 46 and outlet 48 are of course centered about the flow axis 14. A fan 50 with an electric motor 51 and a rotary blade assembly 52 is located within the flow passage 26 to generate the destratifying air flow. The motor 51 is suspended centrally from a 3-inch wide metal strap 53 which spans the diameter of the central housing section 20 and which is bent to conform to the interior of the upper housing section 16 to which the strap 53 is riveted. The opposing end portions 54 of the metal strap 53 are bent to extend horizontally from the top of the upper housing section 16 (in the operative orientation of FIG. 1) and apertured to serve as mounting tabs. The strap end portions 54 are secured with bolts 56 to a ceiling structure 58 (a beam). "Ceiling structure" for purposes of this specification includes any structure proximate to a ceiling, whether below or above. The exact manner in which the air flow producer is supported near a ceiling is not important for purposes of the present invention.

The blade assembly 52 is positioned at the outlet 48 of the flow passage 26 and has a rotational axis aligned with the flow axis 14 of the housing 12. The blade assembly 52 occupies a rotational space 60 (roughly indicated by a rectangle in phantom outline in the cross-sectional view of FIG. 2) primarily within the flow passage 26 but extending partially into the discharge chamber 24. It will be appreciated that the rotational space 60 is actually closer to a torroid but a rectangular radial cross-section has been shown for ease of illustration.

The purpose of the frustoconical intake chamber 22 is to smooth the air flow supplied to the inlet 46 of the flow passage 26, reducing turbulence and increasing flow rates through the housing 12. The intake chamber 22 has one end (upper in the operative orientation of FIG. 2) that defines an inlet 62, spaced axially from the inlet 46 of the flow passage 26, for receiving the air flow. The intake chamber 22 has an opposing end (lower in the operative orientation of FIG. 2) that defines an outlet 64 for discharging the air flow to the flow passage 26. The outlet 64 of the intake chamber 22 is located at the inlet 46 of the flow path and has a cross-sectional area perpendicular to the flow axis 14 that is substantially equal to the cross-sectional area of the flow passage 26. The inlet 62 of the intake chamber 22 has a cross-sectional area perpendicular to the flow axis 14 that is larger than the cross-sectional area of the flow passage 26 perpendicular to the flow axis 14. The shape of the intake chamber 22 and cross-sectional areas relative to the flow path ensure smooth intake of the flow into the flow passage 26.

The discharge chamber 24 communicates directly with the flow passage 26 to receive the air flow. The discharge chamber 24 has an outlet 66 (lower in the operative orientation of FIG. 2) spaced axially from the outlet 48 of the flow passage 26 and discharging the air flow. The discharge chamber 24 has a cross-sectional area perpendicular to the flow axis 14 that expands progressively from the outlet 48 of the flow passage 26 to the outlet 66 of the discharge chamber 24. As mentioned above, the rotational space 60 of the blade assembly 52 extends partially into the discharge chamber 24. This positioning of the blade assembly 52 together with the expanding cross-section appears to reduce turbulence sufficiently to achieve up to 30 percent greater air flow over use of just the central housing section 20 and its flow passage 26. Although use of the intake chamber 22 is preferred, rather than drawing ambient air directly into the circular-cylindrical flow passage 26, actual tests have demonstrated that only a few percent improvement in air flows results.

An appropriate set of dimensions for the air flow producer 10 are as follows. The overall height (axial length) of the housing is about 9–10 inches. The flow passage 26 has a diameter of about 12 inches and an axial length of about 5 inches. The rotary blade assembly 52 has a diameter of about 10 inches. The discharge chamber 24 has an effective axial length of about ½ inch which excludes the one-inch thickness of the grill 28. "Effective axial length" should be understood as length measured axially from the inlet 46 or the outlet 48 of the cylindrical flow passage 26. Also, the grill 28 should be viewed as defining one boundary of the discharge chamber 18 but not as part of the discharge chamber 24. The outlet 66 of the discharge chamber 24 has a diameter of about 14 inches. The intake chamber 22 has an effective axial length of about 3 inches and the inlet 62 of the intake chamber 22 has a diameter of about 18 inches. The air flow grill 28 and retaining collar 36 add about one inch to overall length. The rotational space 60 of the blade assembly 52 extends about ¼ inch into the discharge chamber 24 to about the axial mid-point of the discharge chamber 24. This produces a very marked improvement in performance, as much as 30%. The dimensions may be scaled to provide larger or smaller air flow producer A prototype of the air flow producer 10, constructed as described above, was compared with a leading commercially available unit. The prototype and competitive units had fans with the same motors and blades, but the competitive unit had a square housing whose sides were equal to the diameter of the prototype flow producer 10. A test was performed with a flow meter, and it was found that the competitive unit produced a flow of roughly 1150 feet per minute while the prototype flow producer 10 produced an air flow of 1300 feet per minute. The prototype flow producer 10 showed significantly better performance than the prior art unit.

It will be appreciated that a particular embodiment of the invention has been described and illustrated, and that modifications may be made therein without departing from the spirit of the invention or the scope of the appended claims.

| Parts List: | Industrial Flow Producer |
|---|---|
| 10 | air flow producer |
| 12 | housing |
| 14 | flow axis (housing) |
| 16, 18, 20 | three housing sections (upper, lower, central) |
| 22 | frustoconical intake chamber (upper housing section) |
| 24 | frustoconical discharge chamber (lower housing section) |
| 26 | flow passage (lower housing section) |
| 28 | grill |
| 30 | outer surface (central housing section) |
| 32, 34 | circular collars (upper, lower housing sections) |
| 36 | collar (lower housing section - grill) |
| 38–44 | not used |
| 46 | inlet (central flow passage) |
| 48 | outlet (central flow passage) |
| 50 | fan |

-continued

| Parts List: | Industrial Flow Producer |
|---|---|
| 51 | motor |
| 52 | rotary blade assembly |
| 53 | metal strap |
| 54 | opposing end portions (metal strap) |
| 56 | bolts |
| 58 | beam |
| 60 | rotational space |
| 62 | inlet (intake chamber) |
| 64 | outlet (intake chamber) |
| 66 | outlet (discharge chamber) |

We claim:

1. An air flow producer for reducing temperature gradients in a room, the air flow producer comprising:

a housing with a flow axis, the housing defining (a) a circular-cylindrical flow passage centered about the flow axis, the flow passage having one end defining a circular inlet for receiving an air flow and an opposing end defining a circular outlet for discharging the air flow, and (b) a discharge chamber communicating directly with the flow passage to receive the air flow from the flow passage, the discharge chamber comprising an outlet spaced from the outlet of the flow passage for discharging the air flow, the discharge chamber having a cross-sectional area perpendicular to the flow axis that expands progressively from the outlet of the flow passage to the outlet of the discharge chamber, the discharge chamber has a frustoconical shape; the housing defines a frustoconical intake chamber centered about the flow axis, the intake chamber including:

one end spaced from the inlet of the flow passage and defining an inlet for receiving the air flow, the inlet of the intake chamber having a cross-sectional area perpendicular to the flow axis that is larger than the cross-sectional area of the flow passage perpendicular to the flow axis;

an end located at the inlet of the flow passage and defining an outlet for discharging the air flow into the flow passage, the outlet of the intake chamber having a cross-sectional area perpendicular to the flow axis that is substantially equal to the cross-sectional area of the flow passage;

a fan mounted in the flow passage to generate the air flow, the fan comprising a rotary blade assembly positioned at the outlet of the flow passage and having a rotational axis aligned substantially with the flow axis, the blade assembly occupying a rotational space within the flow passage and extending partially into the discharge chamber; and, an air flow grill mounted to the housing and overlaying the outlet of the discharge chamber, the grill having a flow axis parallel to the flow axis of the housing.

2. The air flow producer of claim 1 in which:

the flow passage has a diameter of about 12 inches and an axial length of about 5 inches;

the blade assembly has a diameter of about 10 inches;

the discharge chamber has an effective axial length of about ½ inch and the outlet of the discharge chamber has a diameter of about 14 inches; and, the intake chamber has an effective axial length of about 3 inches and the inlet of the intake chamber has a diameter of about 18 inches.

3. The air flow producer of claim 2 in which the rotational volume occupied by the blade assembly extends about ¼ inch from the outlet of the flow passage into the discharge chamber.

4. The air flow producer of claim 1 in which:

the flow passage has a diameter of about 12 inches and an axial length of about 5 inches;

the blade assembly has a diameter of about 10 inches; and, the discharge chamber has an effective axial length of about a ½ inch, and the outlet of the discharge chamber has a diameter of about 14 inches.

5. The air flow producer of claim 4 in which the rotational volume of the blade assembly extends about ¼ inch from the outlet of the flow passage into the discharge chamber.

6. In a room with a floor and a ceiling, an air flow producer for reducing temperature gradients between the floor and the ceiling, the air flow producer comprising:

a housing with a vertical flow axis, the housing defining (a) a vertical circular-cylindrical flow passage centered about the flow axis, the flow passage having an upper end defining a circular inlet for receiving an air flow and a lower end defining a circular outlet for discharging the air flow, and (b) a discharge chamber immediately below the flow passage for receiving the air flow discharged from the flow passage, the discharge chamber having a lower end spaced from the outlet of the flow passage and defining an outlet for discharging the air flow vertically downward from the housing, the discharge chamber having a cross-sectional area perpendicular to the flow axis that expands progressively from the outlet of the flow passage to the outlet of the discharge chamber, the discharge chamber has a frustoconical shape; the housing defines a frustoconical intake chamber located immediately above the flow passage and aligned with the flow axis, the intake chamber including:

an upper end spaced from the inlet of the flow passage and defining an inlet for receiving the air flow, the inlet of the intake chamber having a cross-sectional area perpendicular to the flow axis that is larger than the cross-sectional area of the flow passage perpendicular to the flow axis;

a lower end at the inlet of the flow passage and defining an outlet for discharging the air flow into the flow passage, the outlet of the intake chamber having a cross-sectional area perpendicular to the flow axis that is substantially equal to the cross-sectional area of the flow passage;

a fan mounted in the flow passage to produce the air flow, the fan comprising a rotary blade assembly with a vertical rotational axis aligned with the flow axis, the blade assembly having a rotational volume within the flow passage and extending partially into the discharge chamber;

an air flow grill mounted to the housing immediately below the discharge chamber and overlaying the outlet of the discharge chamber, the grill having a vertical flow axis; and, means supporting the housing proximate to the ceiling.

7. The air flow producer of claim 6 in which:

the flow passage has a diameter of about 12 inches and an axial length of about 5 inches;

the blade assembly has a diameter of about 10 inches;

the discharge chamber has an effective axial length of about ½ inch and the outlet of the discharge chamber has a diameter of about 14 inches; and, the intake chamber has an effective axial length of about 3 inches and the inlet of the intake chamber has a diameter of about 18 inches.

8. The air flow producer of claim 7 in which the rotational volume of the blade assembly extends about ¼ inch from the outlet of the flow passage into the discharge chamber.

9. The air flow producer of claim 6 in which:

the flow passage has a diameter of about 12 inches and an axial length of about 5 inches;

the blade assembly has a diameter of about 10 inches; and, the discharge chamber has an effective axial length of about a ½ inch and the outlet of the discharge chamber has a diameter of about 14 inches.

10. The air flow producer of claim 9 in which the rotational volume of the blade assembly extends about ¼ inch from the outlet of the flow passage into the discharge chamber.

* * * * *